US010721959B2

(12) United States Patent
Cieslikowski

(10) Patent No.: US 10,721,959 B2
(45) Date of Patent: Jul. 28, 2020

(54) APPARATUS FOR DETERMINATION OF THE POSITION OF AN INSERT IN ROD-LIKE ARTICLES OF THE TOBACCO INDUSTRY

(71) Applicant: International Tobacco Machinery Poland Sp. Z O.O., Radom (PL)

(72) Inventor: Bartosz Cieslikowski, Radom (PL)

(73) Assignee: International Tobacco Machinery Poland Sp. Z o.o., Radom (PL)

( * ) Notice: Subject to any disclaimer, the term of this patent is extended or adjusted under 35 U.S.C. 154(b) by 68 days.

(21) Appl. No.: 16/097,290

(22) PCT Filed: May 16, 2017

(86) PCT No.: PCT/IB2017/052867

§ 371 (c)(1),
(2) Date: Oct. 29, 2018

(87) PCT Pub. No.: WO2017/212358

PCT Pub. Date: Dec. 14, 2017

(65) Prior Publication Data

US 2019/0133178 A1 May 9, 2019

(30) Foreign Application Priority Data

Jun. 10, 2016 (PL) ..... 417511

(51) Int. Cl.
*A24C 5/34* (2006.01)

(52) U.S. Cl.
CPC ..... *A24C 5/3412* (2013.01)

(58) Field of Classification Search
CPC ..... A24C 5/3412; B07C 5/34; B07C 5/342; B07C 5/3422

(Continued)

(56) References Cited

U.S. PATENT DOCUMENTS 4,011,950 A 3/1977 McLoughlin et al.
4,528,680 A * 7/1985 Archambeault ..... G06M 1/101 209/551

(Continued)

FOREIGN PATENT DOCUMENTS

DE 2542082 A1 * 4/1976 ..... A24C 5/345
DE 2542082 A1 4/1976

(Continued)

OTHER PUBLICATIONS

International Search Report in International application PCT/IB2017/052867, dated Sep. 12, 2017.

*Primary Examiner* — Terrell H Matthews
(74) *Attorney, Agent, or Firm* — Oppedahl Patent Law Firm LLC

(57) ABSTRACT

Apparatus for determination of the position of an insert in rod-like articles (1) used in the tobacco industry, provided with a conveyor (2) for rod-like articles (1) adapted for transporting rod-like articles (1) in a direction of transporting (T) perpendicular to the lengthwise axis (Z) of the rod-like article (1) in a predetermined plane of transporting (A), a radiation source (6), and at least one detector (7, 7A, 7B, 7C, 7D, 7E, 7F), characterised in that the apparatus is provided with a set of at least two sections (F1, F2) of a detector (7, 7A, 7B, 14) and/or two detectors (7C, 7D, 7E, 7F), where the sections (F1, F2) of the detector (7, 7A, 7B, 14) or two detectors (7C, 7D, 7E, 7F) are placed one behind the other in the direction of transporting (T) on the conveyor (2) of rod-like articles (1) in a predetermined spatial orientation in which the radiation (R) hitting on the sections (F1, F2) of the detector (7, 7A, 7B, 14) or the detectors (7C, 7D, 7E, 7F) passes through the rod-like article (1) at different angles (α1, α2); the apparatus is further provided with a controller (20) adapted to receive from the sections (F1, F2) of the detector (7, 7A, 7B) and/or the detectors (7C, 7D, 7E, (Continued)

7F) a sequence of signals (S), where each sequence of signals (S) corresponds to the same rod-like article (1) transported on the conveyor (2), and moreover the controller (20) is adapted so that it determines the position of the insert (1E) in the rod-like article (1) on the basis of the sequence of signals (S) and the parameters of the predetermined spatial orientation of placement of the detectors (7, 7A, 7B, 14, 7C, 7D, 7E, 7F).

8 Claims, 8 Drawing Sheets

(58) Field of Classification Search
USPC ..... 209/536, 576, 577
See application file for complete search history.

(56) References Cited

U.S. PATENT DOCUMENTS 4,785,830 A 11/1988 Hartmann
6,060,677 A * 5/2000 Ulrichsen ..... B07C 5/3425 209/577
6,512,577 B1 * 1/2003 Ozanich ..... G01J 3/0218 356/73
8,186,359 B2 * 5/2012 Ademe ..... A24D 3/0216 131/280
2006/0056577 A1 3/2006 Hunt
2006/0109485 A1 5/2006 Laemmel
2009/0087026 A1 * 4/2009 Xie ..... G01N 23/04 382/103
2016/0091301 A1 3/2016 Hoffmann
2017/0112185 A1 4/2017 Fallon et al.
2019/0261677 A1 * 8/2019 Stolarski ..... G01N 23/083

FOREIGN PATENT DOCUMENTS

DE 102011006449 A1 4/2012
DE 102013203140 A1 * 8/2014 ..... A24C 5/3412
DE 102014209721 A1 * 11/2015 ..... A24C 5/3412
DE 102014209721 A1 11/2015
DE 102014211575 A1 12/2015
EP 0790006 B1 8/1997
EP 2769632 A1 8/2014
WO WO-2014166944 A1 * 10/2014 ..... A24D 3/0229
WO 2015135610 A1 9/2015

* cited by examiner

APPARATUS FOR DETERMINATION OF THE POSITION OF AN INSERT IN ROD-LIKE ARTICLES OF THE TOBACCO INDUSTRY

The subject of the invention is an apparatus for determination of the position of an insert in rod-like articles of the tobacco industry.

The present invention concerns an apparatus for carrying out quality control of products in the tobacco industry. Tobacco industry products including cigarettes, cigarillos, cigars, filter rods made of a single filtering material, multi-segment rods comprising multiple segments, and all types of semi-finished products processed at particular stages of production may be referred to by a common name—rod-like articles. Some rod-like articles, such as filter rods and filter cigarettes, may contain capsules with an aromatic substance. In the tobacco industry the quality of rod-like articles is an exceptionally important issue. Quality control may be performed by random selection or may be applied to all articles produced. Quality control concerns both the appearance and the dimensions of the articles, and in the case of articles containing capsules, the level of filling of the capsules is significant. Tobacco industry articles may contain lengthwise inserts located centrally on the axis, made of synthetic material or metal. Articles may also contain metallised elements made of synthetic material. In the case of quality control concerning the content of articles, for example the position of capsules or inserts in filter rods or in finished cigarettes, it is necessary to image the articles using radiation. Articles are also required to be imaged when checking the dimensions of segments in multi-segment filter rods or checking the dimensions of inserts. Here the radiation sources must be suited to the various materials used by tobacco product manufacturers. The increasing capacities and increasingly complex construction of multi-segment rods result in higher requirements for quality control. Casings for rod-like articles are currently made from a wide variety of materials, some of which are opaque; sometimes the casings contain metal foil, for example aluminium foil. In the case of opaque casing materials, it is difficult to check the content of the articles. Rod-like articles often contain lengthwise elements, for example flavouring threads, tubular elements or lengthwise plates. The purpose of this invention is to provide a way of checking the presence of lengthwise elements and the position of those elements.

Application DE102014209721A1 discloses a method of measuring the parameters of rod-like articles using X-rays. The rod-like articles are placed in a rotating clamp having seats adapted to hold the rod-like articles. During measurement the rotating clamp is rotated about its own axis, which enables registering of the intensity of the radiation passing through the rod-like articles at different angles. A defect of this solution is the fact that the rod-like articles do not rotate about their own axis, but about the axis of the rotating clamp as a whole. The creation of a three-dimensional image of the rod-like articles requires the use of complex processing typical for computed tomography. The presented method may be used in laboratory measurements, in the testing of a selected group of articles. It is not suitable, however, for measurement on an automated production line along which rod-like articles pass in large numbers.

Documents EP0790006B1 and EP2769632A1 disclose methods and devices for the non-invasive measurement of quality parameters of rod-like articles using X-rays, suitable for use on an automated production line. Document EP0790006B1 describes a method and device enabling determination of the density of a rod-like article on the basis of a measurement of the intensity of X-radiation passing through the rod-like article at different thicknesses of the rod-like article. Document EP2769632A1 discloses a method for the measurement of a capsule placed inside a rod-like article, using three independent measuring assemblies performing measurements at different angles. A defect of both of these solutions is that measurement is limited to one article at a time.

The object of the invention is an apparatus for determination of the position of an insert in rod-like articles used in the tobacco industry, provided with a conveyor for rod-like articles adapted for transporting rod-like articles in a direction of transporting perpendicular to the lengthwise axis of the rod-like article in a predetermined plane of transporting, a radiation source, and at least one detector. The apparatus according to the invention is characterised in that it is provided with a set of at least two sections of a detector and/or two detectors. The sections of the detector or two detectors are placed one behind the other in the direction of transporting on the conveyor of rod-like articles in a predetermined spatial orientation in which the radiation hitting on the sections of the detector or the detectors passes through the rod-like article at different angles. The apparatus is further provided with a controller adapted to receive from the sections of the detector and/or the detectors a sequence of signals. Every sequence of signals corresponds to the same rod-like article transported on the conveyor, and moreover the controller is adapted so that it determines the position of the insert in the rod-like article on the basis of the sequence of signals and the parameters of the predetermined spatial orientation of placement of the detectors.

Apparatus as in the invention is characterised in that the apparatus is provided with a rotating unit to rotate the rod-like article during transporting on the conveyor of rod-like articles.

Apparatus as in the invention is characterised in that the spatial orientation of the detectors is selected so that the radiation hits on the detectors perpendicularly.

Apparatus as in the invention is characterised in that the spatial orientation of the detectors is selected so that the radiation hits on the radiation detectors at an acute angle.

Apparatus as in the invention is characterised in that at least one detector is a linear matrix of radiation detectors.

Apparatus as in the invention is characterised in that at least one detector has the form of a two-dimensional matrix of radiation detectors.

Apparatus as in the invention is characterised in that it determines the position of the insert in the rod-like article in three-dimensional space on the basis of the sequence of signals from the detectors and the parameters of the predetermined spatial orientation of the radiation source and detectors.

Apparatus as in the invention is characterised in that the radiation source is a source of electromagnetic radiation having a frequency in the range $10^{12}$ to $10^{19}$ Hz.

An advantage of the invention is that it enables radiological measurement determining the position in space of internal elements of rod-like products on the production line. Due to the use of a source of known geometry, in a production line it is possible to test all products being produced and to eliminate defective products at further stages of production, which leads to improvement in quality.

The object of the invention is shown in detail in a preferred embodiment in the drawing, where:

Figure 2:
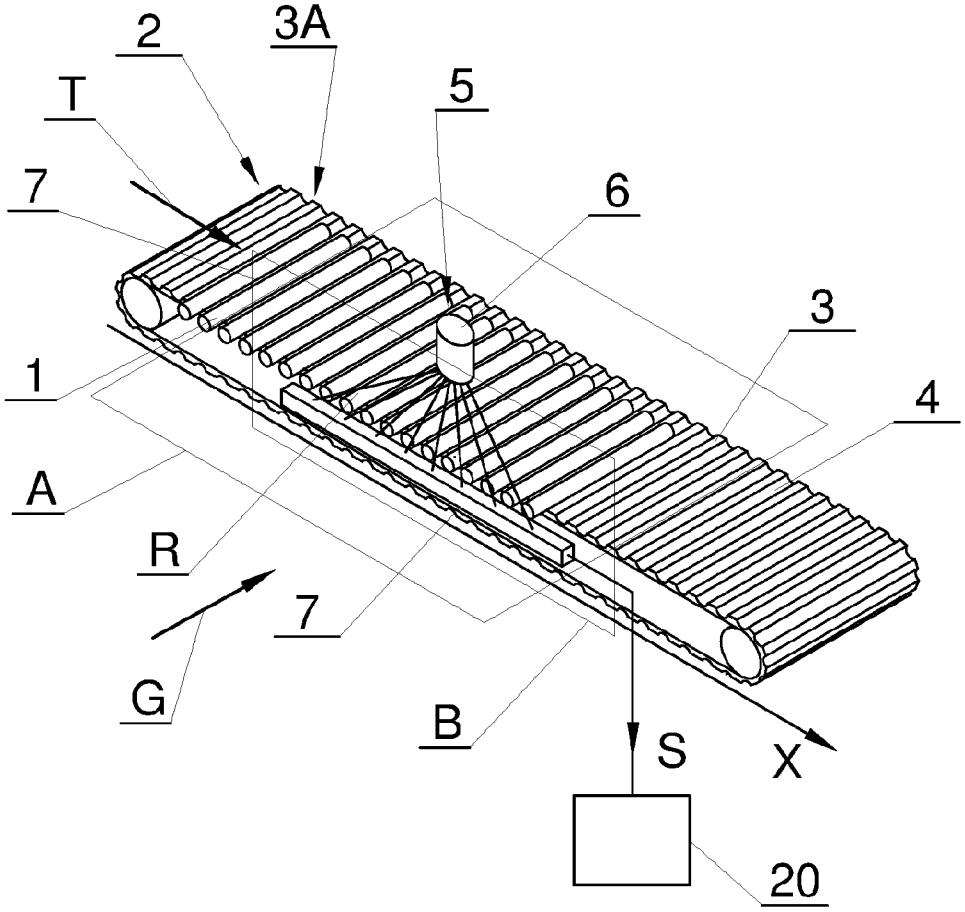
FIG. 2 shows the first embodiment of the apparatus according to the invention.
Figure 3A:
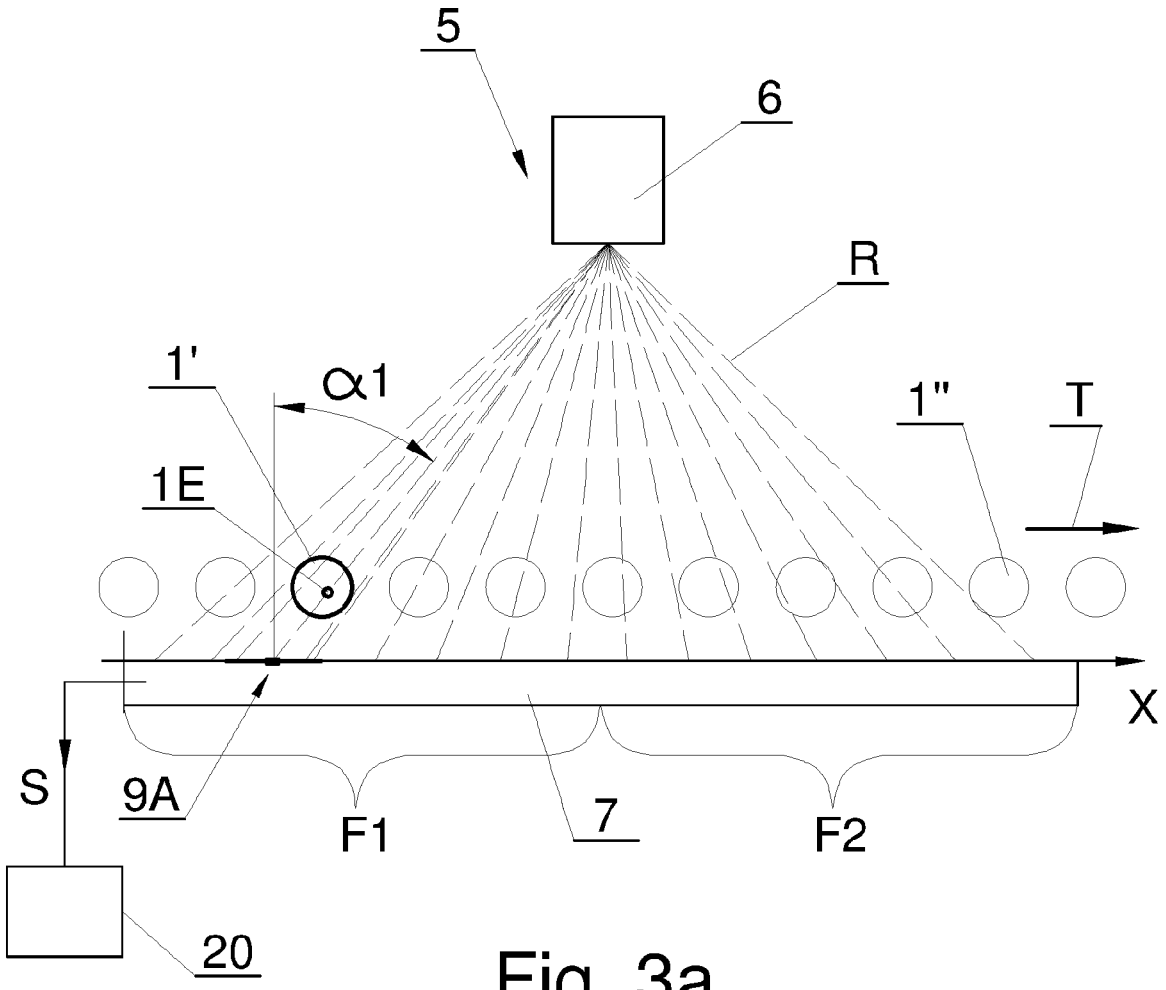
Figure 3B:
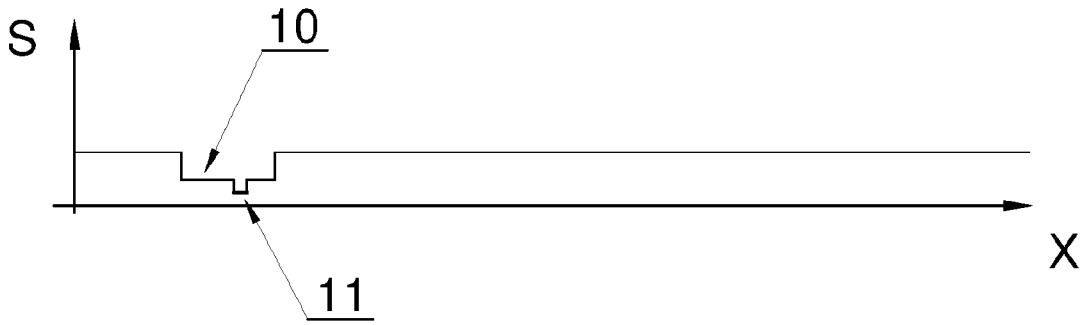
Figure 4A:
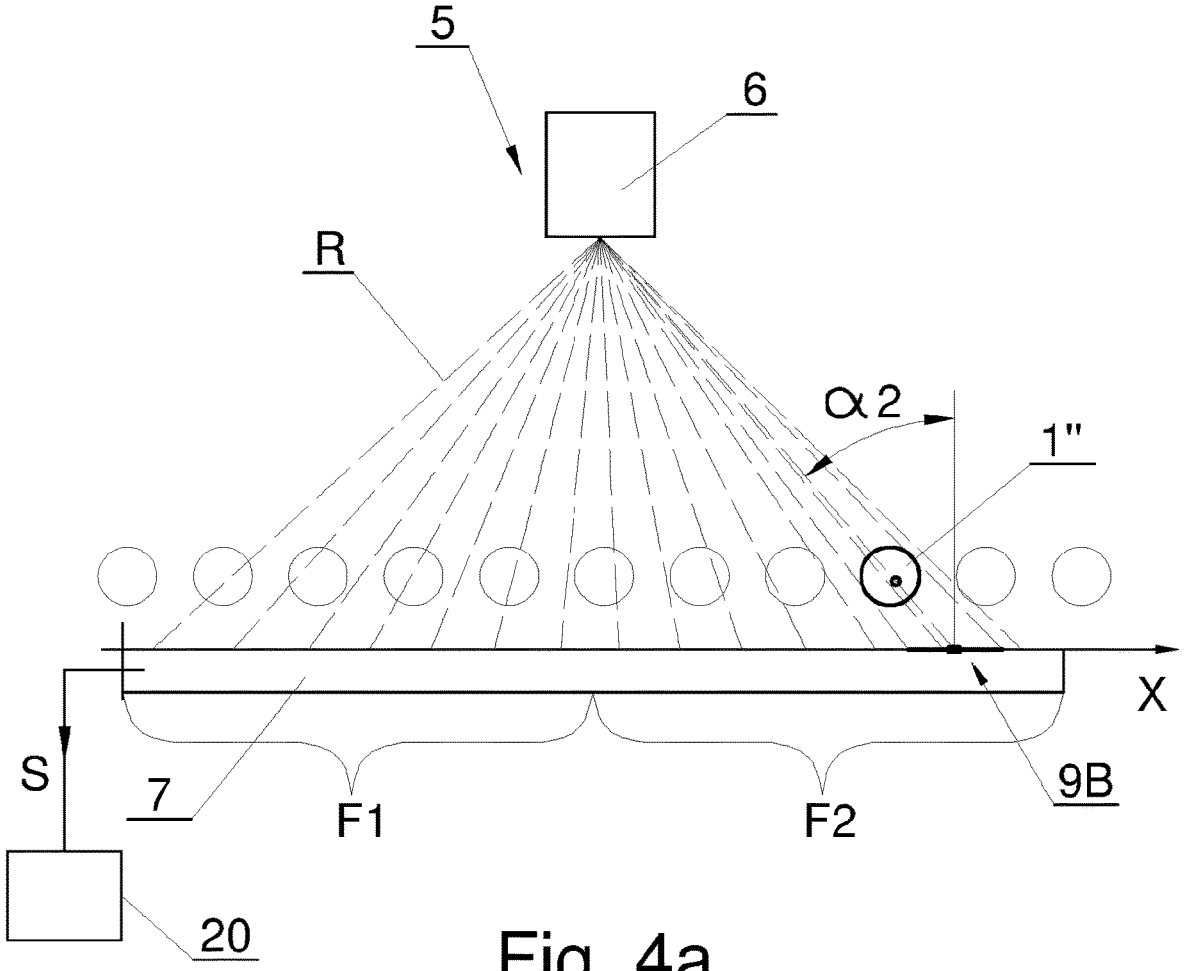
Figure 4B:
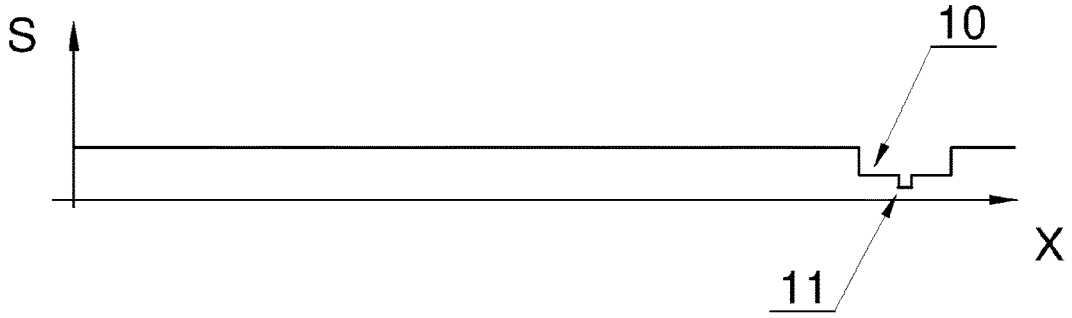
Figure 5A:
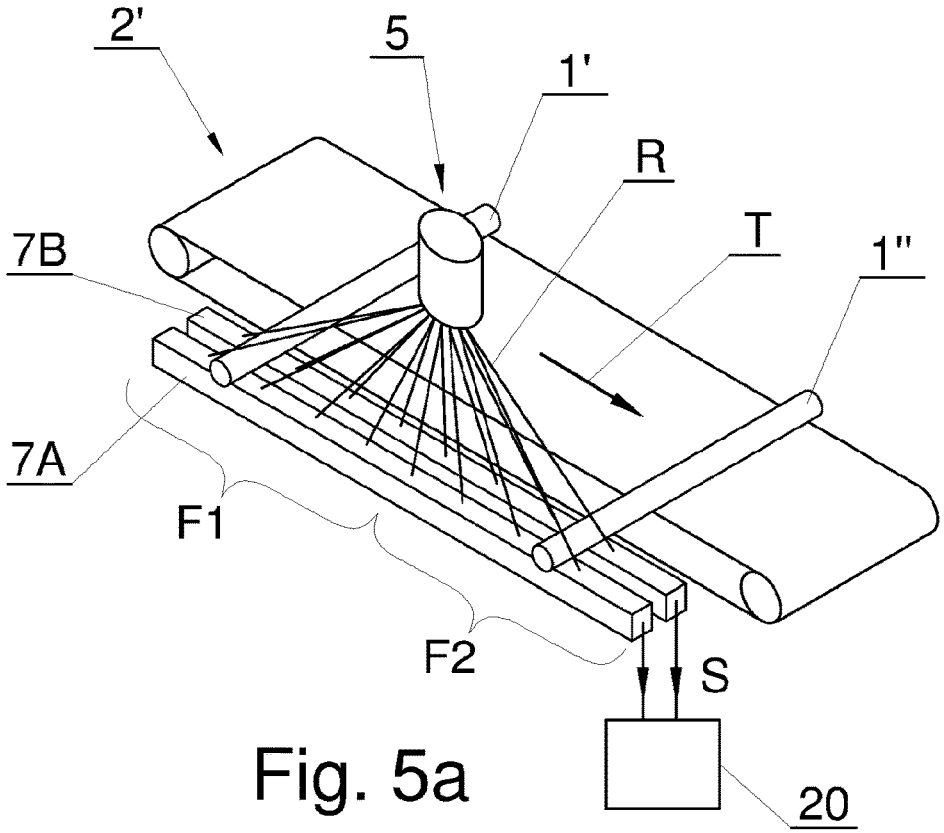
Figure 5B:
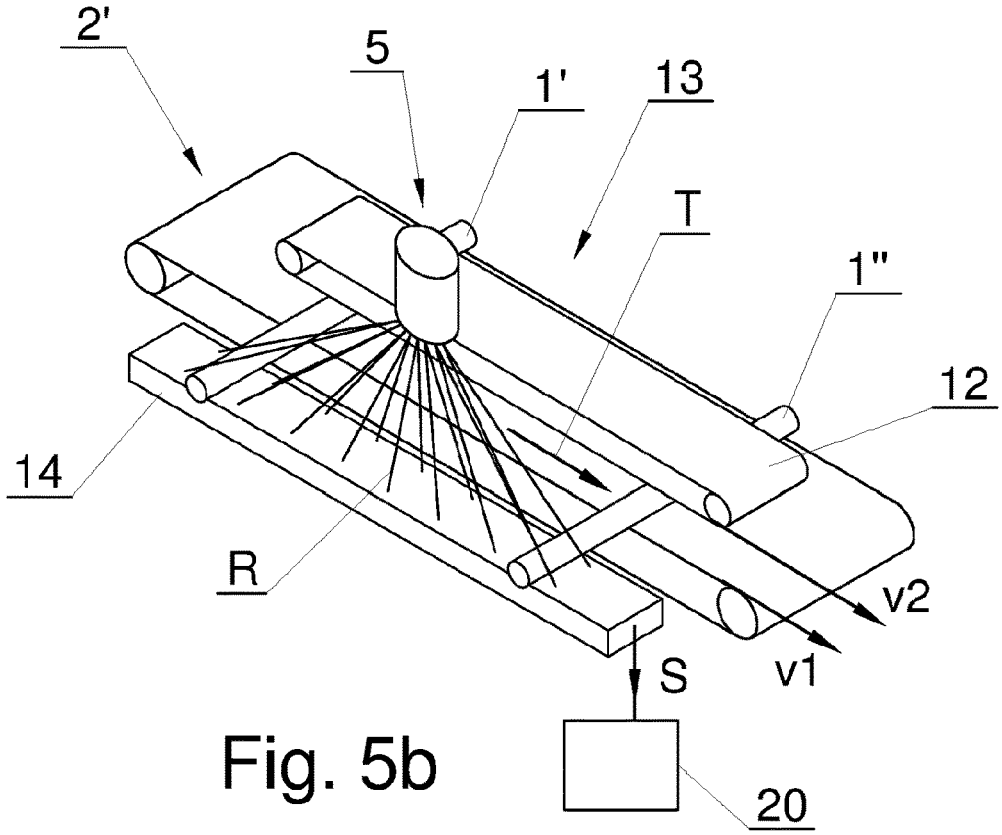
Figure 6:
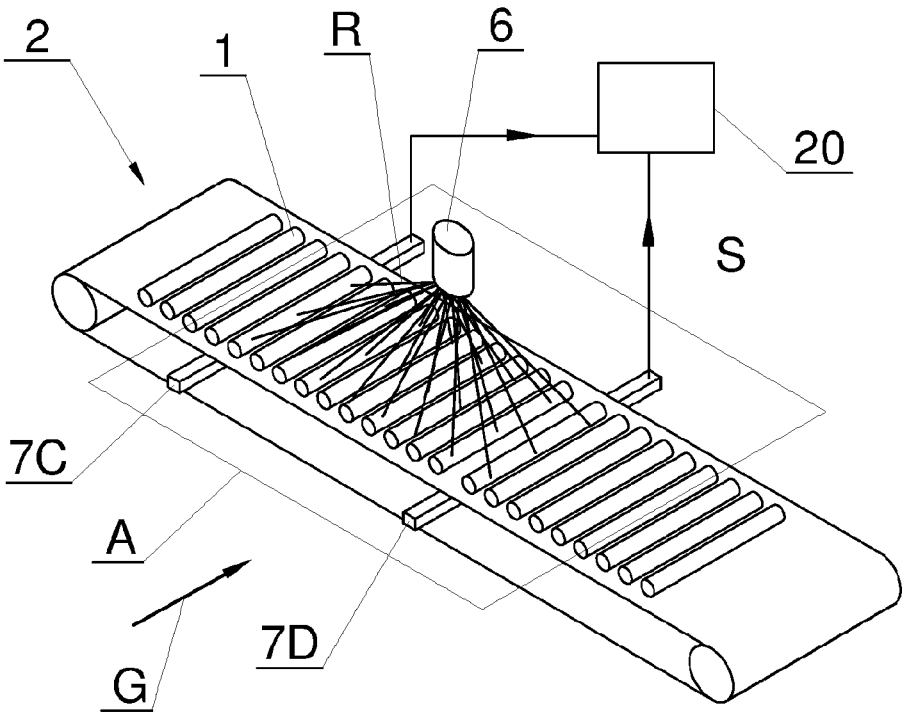
Figure 7A:
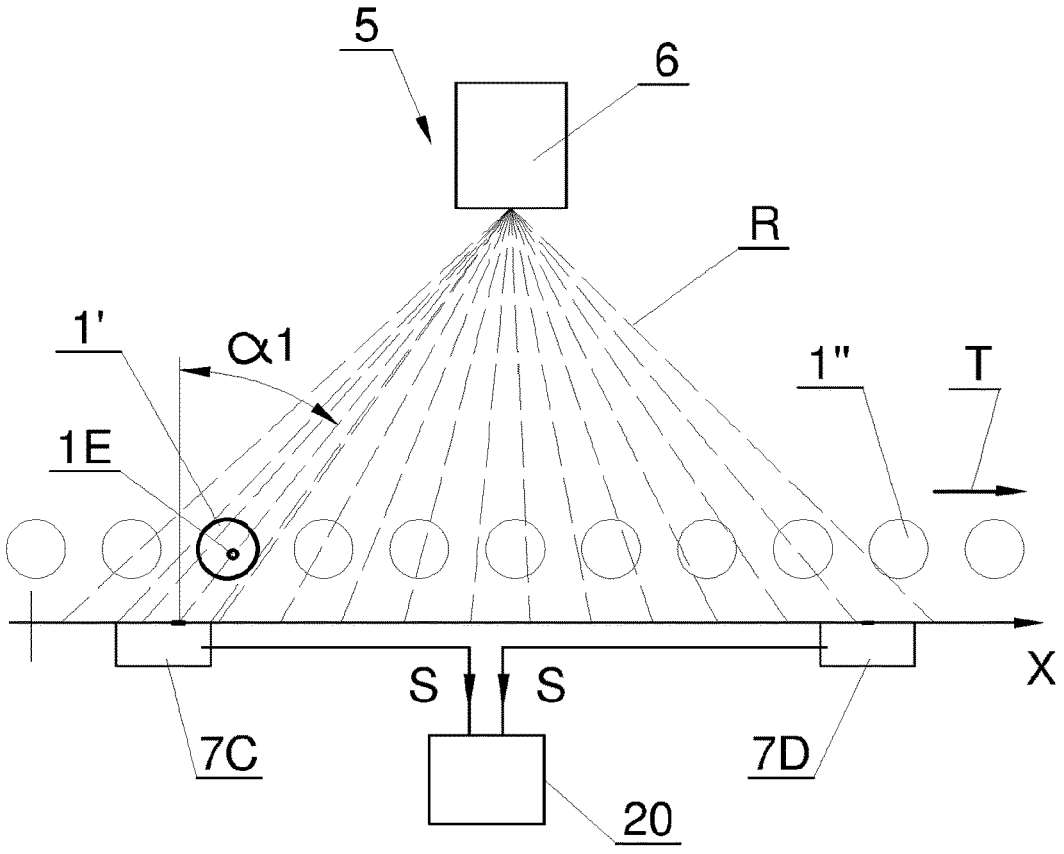
Figure 7B:
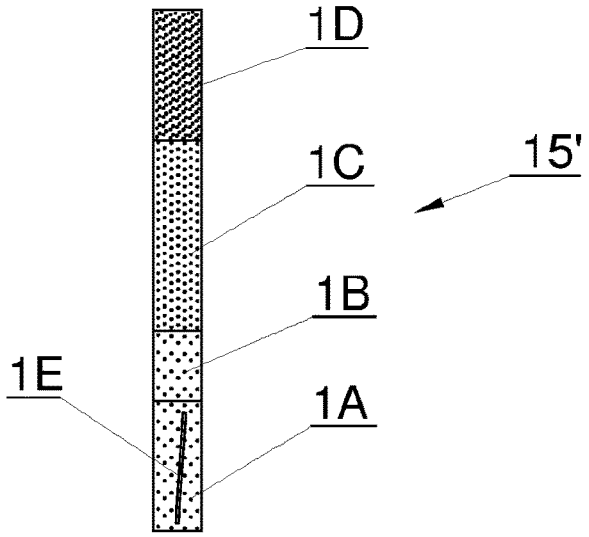
Figure 8A:
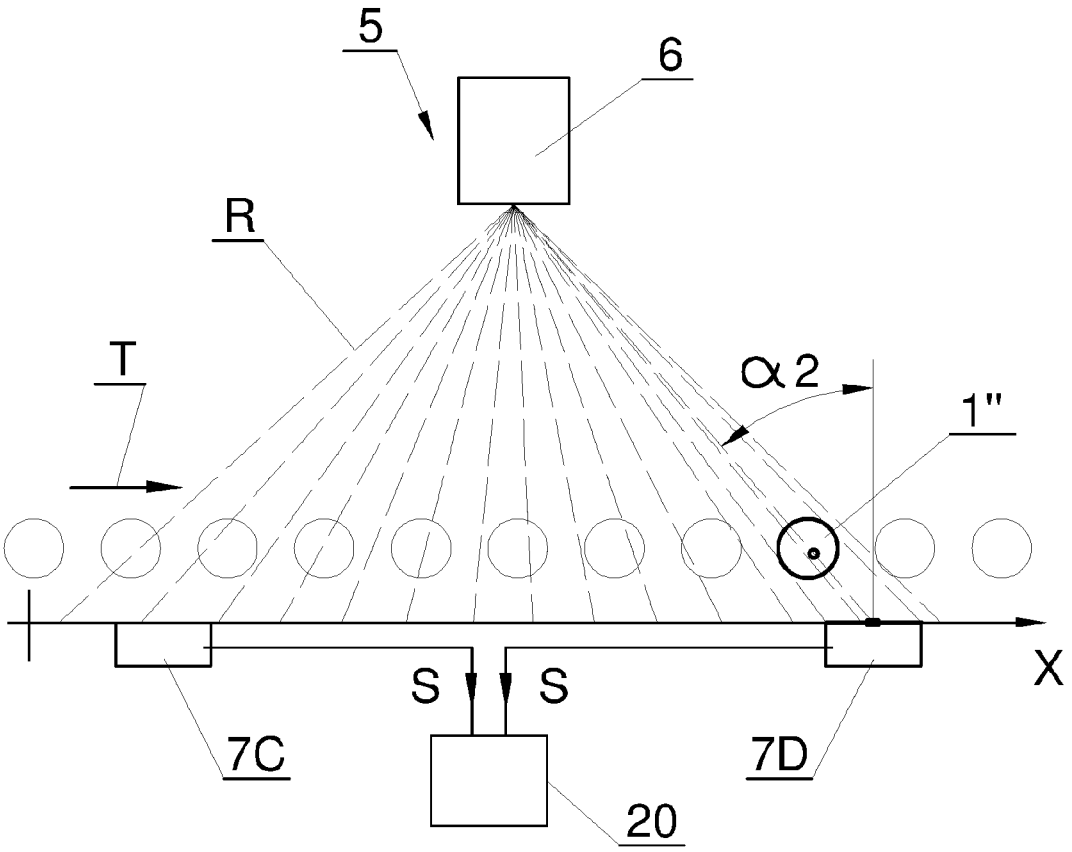
Figure 8B:
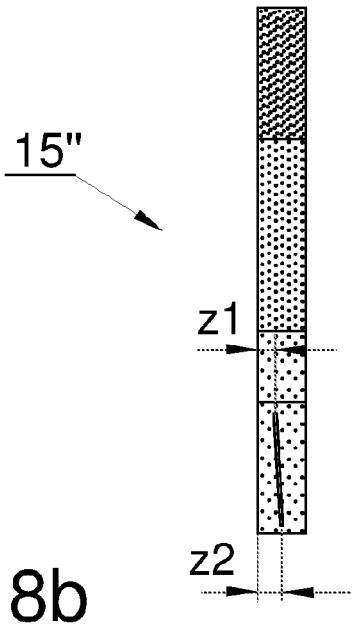
Figure 9A:
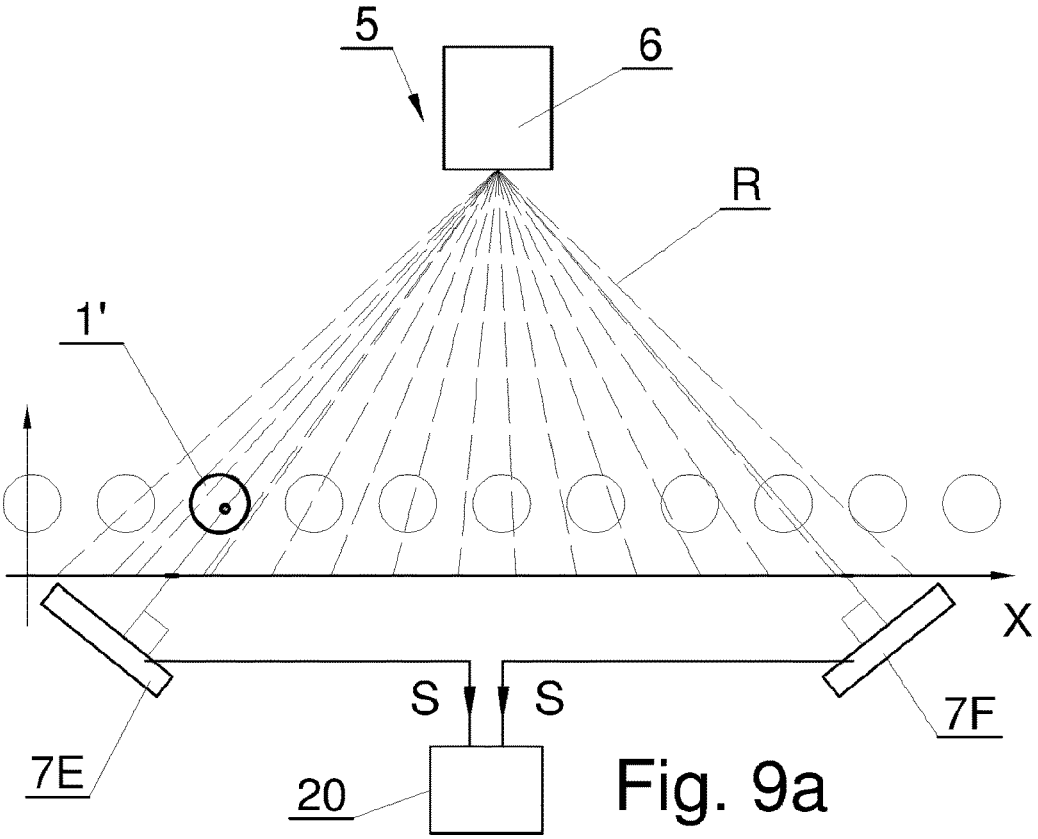
Figure 9B:
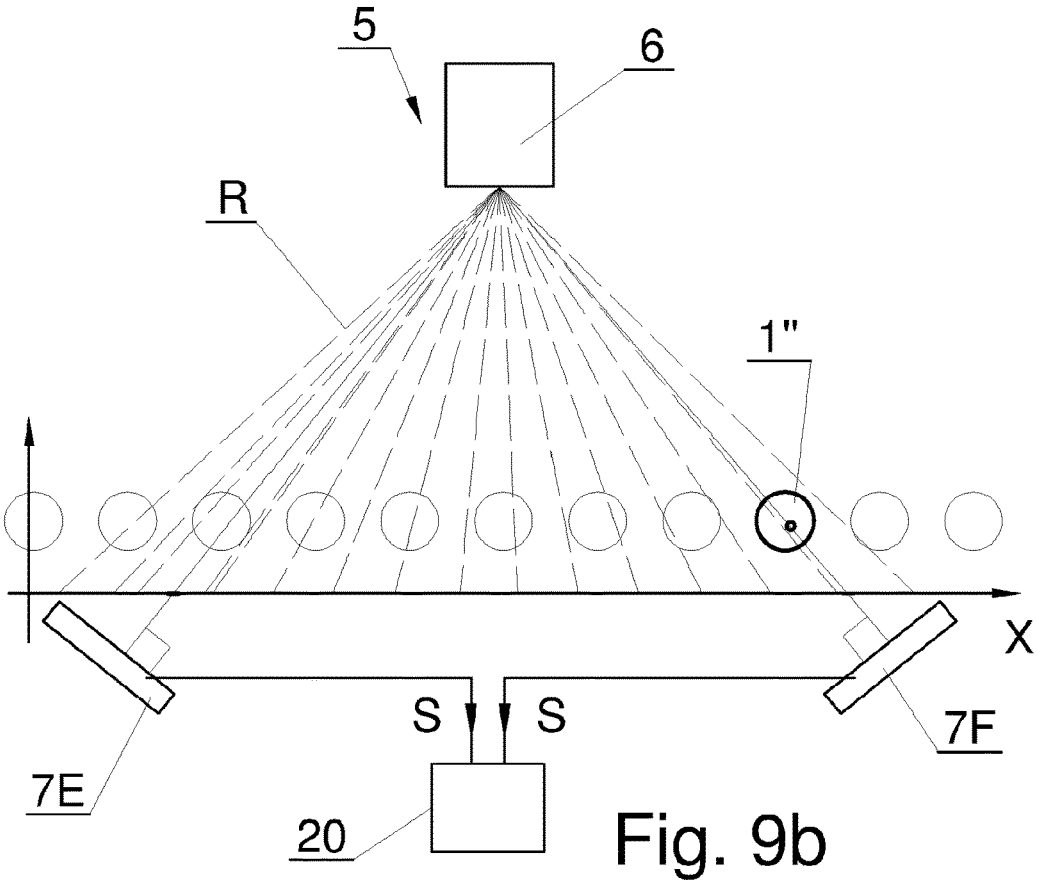

FIG. 3*a* shows the first embodiment of the apparatus according to the invention in a projection in the direction G of FIG. 2, where the tested rod-like article is in the first position;

FIG. 3*b* shows a signal generated by the detector of the apparatus according to the invention, where the tested rod-like article is in the first position;

FIG. 4*a* shows an example of an embodiment of the apparatus according to the invention in a projection in the direction G of FIG. 2, where the tested rod-like article is in the second position;

FIG. 4*b* shows a signal generated by the detector of the apparatus according to the invention, where the tested rod-like article is in the second position;

FIG. 5*a* shows the second embodiment of the apparatus according to the invention;

FIG. 5*b* shows the third embodiment of the apparatus according to in the invention;

FIG. 6 shows a further embodiment of the invention;

FIG. 7*a* shows the principle of operation of the apparatus according to the invention, where the tested rod-like article is in the first position;

FIG. 7*b* shows an image of a rod-like article in the first position, generated by the apparatus according to the invention;

FIG. 8*a* shows the principle of operation of the apparatus according to the invention, where the tested rod-like article is in the second position;

FIG. 8*b* shows an image of a rod-like article in the second position, generated by the apparatus according to the invention;

FIGS. 9*a* and 9*b* show a further embodiment of the apparatus according to the invention.

Figure 1:
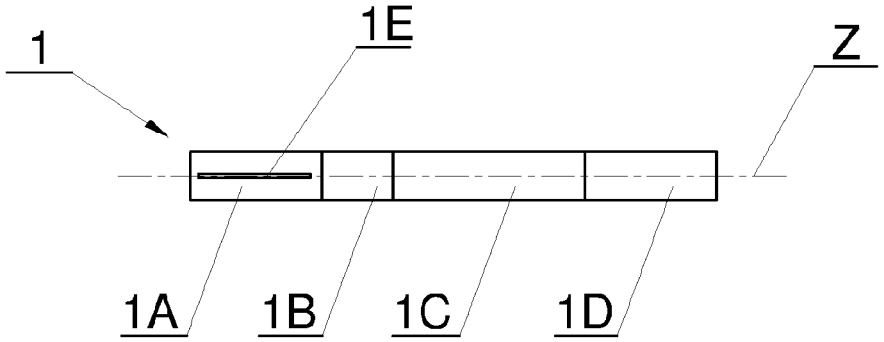
FIG. 1 shows a rod-like article schematically, its particular component elements being marked.

An example rod-like article 1 of the tobacco industry shown in FIG. 1, in the form of a multi-segment filter rod, comprises four segments 1A, 1B, 10 and 1D, where the segment 1A contains a lengthwise insert 1E. The insert 1E may be made of metal or plastic, in particular metallised plastic, and may also contain aromatic substances. The insert may have the form of a thread, wire, tube, or a flat plate-type element of any shape. For example, the insert 1E is placed centrally, co-axially with the axis Z of the rod-like article 1.

FIG. 2 shows a part of a production line including a conveyor 2 adapted to transport a single-layer stream of rod-like articles 1 as used in the tobacco industry in a direction of transporting T perpendicular to the lengthwise axis Z of the rod-like articles 1, where the rod-like articles 1 are transported in a plane of transporting A which is in principle horizontal. On the outer surface of the belt 3 of the conveyor 2 there are flutes 4 made perpendicularly to the direction of transporting T. The rod-like articles 1 are placed in the flutes 4 of the conveyor 2 by means of any device (not shown), for example the rod-like articles 1 may be fed from a drum conveyor having a plurality of flutes on its circumference, where the movement of the drum conveyor is synchronized with the movement of the conveyor 2. The illustrated part of the production line also includes a measuring unit 5. The measuring unit 5 consists of a radiation source 6 and at least one detector 7. In this description, the detector 7 is understood as a radiation detector used to receive radiation of a frequency as indicated below, where this may be a linear matrix of radiation detectors or a two-dimensional matrix of radiation detectors. The radiation source 6 is located above the carrying surface 3A of the belt 3 and above the plane of transporting A. The detector 7 is located below the surface of the belt 3 and below the plane of transporting A. A reverse configuration is also possible, where the radiation source 6 is located below the plane of transporting A, and the detector 7 above it. The radiation source 6 and the detector 7 are located in a plane B which is in principle vertical, perpendicular to the carrying surface 3A of the belt 3 and to the plane of transporting A. The plane B and the detector 7 itself are positioned parallel to the direction of transporting T of rod-like articles 1. The radiation source 6 emits radiation R which passes through the rod-like articles 1 moving in the plane of transporting A and reaches the detector 7. The detector 7 may be adapted to detect the intensity of electromagnetic radiation for wave frequencies in the range $10^{12}$ to $10^{19}$ Hz. The example embodiment uses a detector 7 in the form of a linear matrix of detectors adapted to receive radiation R emitted from the radiation source 6. The radiation source 6 may be adapted to produce a flat sheet beam, that beam being directed towards the detector 7. It is possible to use a radiation source 6 in which the intensity of radiation or exposure time can be adjusted to the speed of transporting of the rod-like articles 1.

FIG. 3*a* shows the measuring unit 5 in a projection in the direction G (FIG. 2), where the conveyor 2 is not shown, only the rod-like articles 1 being transported by the conveyor 2 in the direction of transporting T parallel to the axis X which is also shown in FIG. 2. To describe the operation of the measuring unit 5, a rod-like article 1 in position 1' has been selected. The detector 7 receives the radiation R, where the detector 7 may be divided into at least two sections F1 and F2. For a specific position 1' of the rod-like article 1 the radiation R hits on the detector 7 at a predetermined angle $\alpha$1, where the intensity of the radiation R which hits on the section of the detector 7 is dependent on the damping of the radiation R by the material of the rod-like article 1. The denotation 9A refers to the part of the detector 7 registering the change in the intensity of the radiation R which has passed through the rod-like article 1.

FIG. 3*b* shows the signal S generated by the radiation detector 7 in the presence of the rod-like article 1 in position 1', where the radiation R passing through the rod-like article 1 reaches the detector 7 within the area of the section F1. The reduction 10 in the value of the signal S results from the damping of the radiation R, for example by the material of the segment 1A, assuming that the rod-like articles 1 are arranged in segments 1A above the detector 7. In turn, the reduction 11 in the value of the signal S results from the damping of the radiation R by the material of the insert 1E and the material of the segment 1A. For each rod-like article 1 in position 1' for which a change in the intensity of radiation R is registered, the detector 7 sends a signal S to the controller 20.

FIG. 4*a* shows a measuring unit 5 analogously to FIG. 3*a*, the rod-like article 1 being in position 1", where the radiation R passing through the rod-like article reaches the detector 7 within the area of the section F2. FIG. 4*b* shows the signal S registered by the section F2 of the detector 7 in the presence of the rod-like article 1 in position 1". The presence of the rod-like article 1 in position 1" causes a change in the signal S in the part of the section F2 of the linear detector 7 denoted as 9B, where the radiation R hits on the detector 7 at an angle $\alpha$2 which is different than in the section F1. The course of the signal S in the form of a reduction 10 in the value of the signal and the reduction 11 in the value of the signal for the position of the insert 1E in the segment 1A in the section F2 is different from the course of the signal S in the section F1. Information on the change in the intensity of radiation R for the rod-like article in position 1" is sent to the controller 20 in the form of a signal S. The reduction 10 and 11 in the value of the signal S may be registered by the controller 20 continuously along the sections of the detector 7 for the rod-like article 1 or for more than two selected positions 1', 1" of that article in the sections F, F2 of the detector 7. On the basis of the data collected in the form of a sequence of signals S from the detector 7 it is possible to calculate the actual position of the insert 1E in the segment 1A by means of geometrical calculations. Here it is necessary to know the spatial orientation at the making of measurements, i.e. in this case the distance between the parts 9A and 9B and the angles α1 and α2. On the basis of the sequence of signals S registered in the controller 20 it is possible to assign to each rod-like article 1 the information on the presence of the insert 1E and on the position of the insert 1E relative to the axis of the segment 1A, and the information may be used to reject rod-like articles 1 in which the insert 1E is not present or is incorrectly located, for example not co-axially with the axis Z.

FIG. 5*a* shows an example of an embodiment of the apparatus as in the invention in which two detectors 7A and 7B are located next to each other, where for simplicity the same rod-like article 1 is shown in positions 1' and 1" on the conveyor 2. The signal S is registered for positions 1' and 1" in sections F1 and F2 of the linear detectors 7A and 7B. Such a geometrical orientation of the detectors 7A and 7B may be used for precise determination of the position of the insert 1E in the rod-like article 1, because it is also possible to check the angular position of the insert 1E relative to the axis Z of the rod-like article 1.

FIG. 5*b* shows an example of an embodiment in which a second conveyor 12 is located above the conveyor 2 so that the distance between the belts of the conveyors 2 and 12 is close to the diameter of the rod-like article 1, for example the distance between the belts of the conveyors 2 and 12 is smaller than the diameter of the rod-like article 1. The linear speed v1 of the conveyor 2 is lower than the linear speed v2 of the conveyor 12, which means that the articles moving linearly in the direction of transporting T additionally rotate about their own axes. The conveyor 12 belongs to the rotating unit 13. Smooth rotation of the rod-like articles 1 during transporting in the direction T may be achieved by any other method. The radiation R passing through the rod-like article 1 generates an image on the detector 14, which has the form of a two-dimensional matrix of detectors. Taking into account the spatial configuration in which the measurements are made and taking into account the speed of rotation of the rod-like article 1, it is possible to obtain a precise spatial image of the rod-like article 1 and to assess the content of the rod-like article 1 in three-dimensional space.

FIG. 6 shows another embodiment of the apparatus as in the invention, where the detectors 7C and 7D are located perpendicularly to the direction of transporting T of the rod-like articles 1 on the conveyor 2, below the plane of transporting A. The radiation source 6 may be adapted to produce a directional cone-shaped beam, that beam being directed at the detectors 7C and 7D.

FIG. 7*a* shows the operation of the measuring unit 5 in relation to the rod-like article 1 in position 1'. Analogously to FIG. 3*a*, the conveyor is not shown, only the rod-like articles 1 and detectors 7C and 7D. Detector 7C receives the radiation R which has passed through the rod-like article 1 and hits on the detector 7C at the predetermined angle α1. The intensity of the radiation R received by the detector 7C is dependent on the damping of the radiation R by the material of the rod-like article 1. The detector 7C generates a signal S registered by the controller 20. Successive signals S for successive positions of the rod-like article 1 moving in the direction of transporting T are registered within the area of the detector 7C, due to which in the controller 20, based on a combination of many signals S, a two-dimensional image 15' of the rod-like article 1 is produced, as shown in FIG. 7*b*. Each registered signal S for a successive position of the rod-like article 1 produces a further line of the image being generated. On the image 15' of the rod-like article 1, all the component elements of the rod-like article 1 are visible, namely the segments 1A, 1B, 1C and 1D and the insert 1E.

FIG. 8*a* shows the same measuring unit 5 as in FIG. 7*a*, where a measurement is made for the rod-like article 1 in position 1", which has moved in the direction T. For the rod-like article 1 in position 1" a signal S is registered by the linear detector 7D, where the radiation R hits on the detector 7B at an angle α2 different from that for the detector 7C. FIG. 8*b* shows an image 15" of the rod-like article 1 generated analogously to that shown in FIG. 7*b*. From the images 15', 15" of the same rod-like article 1, obtained respectively in positions 1' and 1" and shown in FIG. 7*b* and FIG. 8*b*, it can be seen that the insert 1E is positioned at a certain angle to the axis of the rod-like article 1. In the obtained images 15', 15" it is possible to measure the dimensions of the elements of the rod-like article 1, for example it is possible to measure the position of the ends of the insert, defined by the dimensions z1 and z2. Having a sequence of measurements for a predetermined spatial orientation of the detectors 7C and 7D and for the angles at which the radiation R hits, it is possible to perform geometric calculations to determine the actual position of the insert 1E in the rod-like article 1 in three-dimensional space.

FIGS. 9*a* and 9*b* show another embodiment of the apparatus using detectors 7E and 7F in the form of two-dimensional matrices of detectors. For predetermined positions of the rod-like article 1, images are registered on the detectors 7E and 7F, where the radiation hits on the detectors 7E and 7F perpendicularly. FIG. 9*a* shows a rod-like article 1 in position 1', for which an image is registered on the detector 7E, while FIG. 9*b* shows the position of the rod-like article 1 in position 1", for which an image is registered on the detector 7F. In this way, images as shown in FIG. 7*b* and FIG. 8*b* are obtained.

The invention claimed is:

1. An apparatus for determination of the position of an insert in rod-like articles (1) of the tobacco industry, provided with a conveyor (2) for rod-like articles (1) adapted for transporting rod-like articles (1) in a direction of transporting (T) perpendicular to the lengthwise axis (Z) of the rod-like article (1) in a predetermined plane of transporting (A), a radiation source (6), at least one detector (7, 7A, 7B, 7C, 7D, 7E, 7F), characterised in that the apparatus is provided with a set of at least two sections (F1, F2) of a detector (7, 7A, 7B, 14) and/or two detectors (7C, 7D, 7E, 7F), where the sections (F1, F2) of the detector (7, 7A, 7B, 14) or two detectors (7C, 7D, 7E, 7F) are placed one behind the other in the direction of transporting (T) on the conveyor (2) of rod-like articles (1) in a predetermined spatial orientation in which the radiation (R) hitting on the sections (F1, F2) of the detector (7, 7A, 7B, 14) or the detectors (7C, 7D, 7E, 7F) passes through the rod-like article (1) at different angles (α1, α2);

the apparatus is further provided with a controller (20) adapted to receive from the sections (F1, F2) of the detector (7, 7A, 7B) and/or the detectors (7C, 7D, 7E, 7F) a sequence of signals (S), where each sequence of signals (S) corresponds to the same rod-like article (1) transported on the conveyor (2), and moreover the controller (20) is adapted so that it determines the position of the insert (1E) in the rod-like article (1) on the basis of the sequence of signals (S) and the parameters of the predetermined spatial orientation of placement of the detectors (7, 7A, 7B, 14, 7C, 7D, 7E, 7F).

2. The apparatus of claim 1, characterised in that the apparatus is provided with a rotating unit (13) to rotate the rod-like article (1) during transporting on the conveyor (2) of rod-like articles (1).

3. The apparatus of claim 1, characterised in that the spatial orientation of the detectors (7C, 7D) is selected so that the radiation (R) hits on the detectors (7E, 7F) perpendicularly.

4. The apparatus of claim 1, characterised in that the spatial orientation of the detectors (7A, 7B, 7C, 7D) is selected so that the radiation (R) hits on the radiation detectors (7A, 7B, 7C, 7D) at an acute angle.

5. The apparatus of claim 1, characterised in that at least one detector (7, 7A, 7B, 7C, 7D) is a linear matrix of radiation detectors.

6. The apparatus of claim 1, characterised in that at least one detector (7E, 7F) has the form of a two-dimensional matrix of radiation detectors.

7. The apparatus of claim 5, characterised in that the controller (20) is adapted so that it determines the position of the insert (1E) in the rod-like article (1) in three-dimensional space on the basis of the sequence of signals (S) from the detectors (7, 7A, 7B, 7C, 7D) and the parameters of the predetermined spatial orientation of the radiation source (6) and detectors (7, 7A, 7B, 7C, 7D).

8. The apparatus of claim 1, characterised in that the radiation source (6) is a source of electromagnetic radiation with a frequency in the range $10^{12}$ to $10^{19}$ Hz.

* * * * *